US007571824B2

(12) United States Patent
Duncan

(10) Patent No.: US 7,571,824 B2
(45) Date of Patent: Aug. 11, 2009

(54) METHOD OF CONVERTING OFF-SHORE INSTALLED PEDESTAL CRANES LINK BELT MODELS 218 AND 238 FROM MECHANICAL TO FULL HYDRAULIC OPERATION

(75) Inventor: Glen Duncan, Franklinton, LA (US)

(73) Assignee: Solution Crane Services Mexico S. de R.L. de C.V, Campeche, C.P. (MX)

( * ) Notice: Subject to any disclaimer, the term of this patent is extended or adjusted under 35 U.S.C. 154(b) by 58 days.

(21) Appl. No.: 12/002,405

(22) Filed: Dec. 17, 2007

(65) Prior Publication Data

US 2008/0173607 A1 Jul. 24, 2008

Related U.S. Application Data

(60) Provisional application No. 60/870,994, filed on Dec. 20, 2006.

(51) Int. Cl.
*B66C 23/52* (2006.01)

(52) U.S. Cl. ..... 212/270; 29/401.1; 37/397; 212/307

(58) Field of Classification Search ..... 37/397; 212/270, 307; 29/401.1
See application file for complete search history.

(56) References Cited

U.S. PATENT DOCUMENTS 2,703,180 A * 3/1955 Brown ..... 212/239
5,048,172 A * 9/1991 Gravenhorst ..... 29/401.1
5,992,655 A * 11/1999 Greenberg et al. ..... 212/258

* cited by examiner

*Primary Examiner*—Thomas J. Brahan
(74) *Attorney, Agent, or Firm*—James Ray & Assoc.

(57) ABSTRACT

A method of converting off-shore installed pedestal crane from a mechanical to a hydraulic operation includes the steps of determining a load limit capable of being lifted by the hooks of the existing crane, ascertaining structural condition of the existing crane, determining operating performance parameters for and selecting various members of a hydraulic system, defining configuration and position of mounting members to mount each selected hydraulically operated member, removing existing mechanically operated components, rigidly securing the mounting members to the existing winch frame, affixing hydraulically operated members to respective mounting member and interconnecting them therebetween with hoses, and testing and certifying performance of the hydraulically operated system.

15 Claims, 4 Drawing Sheets

METHOD OF CONVERTING OFF-SHORE INSTALLED PEDESTAL CRANES LINK BELT MODELS 218 AND 238 FROM MECHANICAL TO FULL HYDRAULIC OPERATION

CROSS-REFERENCE TO RELATED APPLICATIONS

This application is related to and claims priority from Provisional Patent Application Ser. No. 60/870,994 filed on Dec. 20, 2006.

FIELD OF THE INVENTION

The present invention relates, in general, to off-shore cranes and, more particularly, this invention relates to a method of converting on off-shore installed pedestal cranes Link Belt Models 218 and 238 from a mechanical to a total hydraulic operation.

BACKGROUND OF THE INVENTION

As is generally well known, a vast majority of industrial mechanically operated cranes installed on off-shore platforms require greater than desired repair and maintenance effort and, subsequently, a greater life cycle cost associated therewith. The repair and maintenance costs increase with the increase in crane age and use. Of a particular concern are pedestal-type cranes Link Belt Models 218 and 238 which include a pedestal secured to an off-shore platform, a turntable attached to the pedestal, a main frame rotatably attached to the turntable, a boom pivotally mounted on the main frame and having cables and hooks suspended therefrom, a winch frame secured to the main frame and having a pair of side members and a operator cab secured to the main frame and a trio of mechanically operated winches mounted within the winch frame each connected to a respective cable.

Furthermore, it is also generally known that such mechanically operated cranes pose numeral safety hazards to operating personnel.

Prior to the conception and design of the present invention these mechanically operated pedestal-type cranes were being retrofitted in their entirety with a new type of cranes having hydraulically operated winches and turntable mechanism. While such hydraulically operated cranes increase performance efficiency and reduce maintenance costs, the overall retrofit (replacement) costs, which are predominantly influenced by the cost of the new crane, impact the profitability of the many off-shore platforms and cannot be easily absorbed by the owners of such platforms.

Therefore, there is a need to improve performance of existing pedestal-type cranes installed on off-shore platforms while minimizing the overall retrofit costs.

SUMMARY OF THE INVENTION

The present invention provides a method of converting off-shore installed pedestal crane from a mechanical to a hydraulic operation. The crane has a pedestal which is secured to an off-shore platform. A turntable is attached to the pedestal and a main frame is rotatably attached to the turntable. A boom is pivotally mounted on the main frame and has cables and hooks suspended therefrom. A winch frame is secured to the main frame and has a pair of side members. An operator cab is stationary secured to the main frame. The method includes the step of determining a load limit capable of being lifted by the hooks of the crane. Then, ascertaining condition of the crane. Next, determining operating performance parameters for a hydraulic system. Selecting members of the hydraulically operated system in accordance with the determined operating performance parameters. Such members includes a triad of winches, a pair of gearboxes, a pump drive assembly, a reservoir of hydraulic fluid and plurality of control valves. Then, defining configuration and position of mounting members to mount each hydraulically operated winch and gearbox. Next, removing existing mechanically operated and auxiliary members to be replaced. Rigidly securing the mounting members to the side members of the winch frame. Then, mounting each of the triad of hydraulically operated winches to a respective mounting member. Next, attaching each cable to a respective winch. Mounting each of the pair of hydraulically operated gearboxes to the remaining respective mounting members in operable engagement with the turntable. Then, attaching the pump drive assembly to the engine. Next, installing the reservoir of hydraulic fluid and plurality of control valves. Interconnecting the hydraulically operated winches, the gearboxes, and the pump drive assembly with the reservoir of hydraulic fluid and plurality of control valves. Next, testing performance of the hydraulically system. Finally, certifying, by a certifying agency, performance of the tested hydraulic system.

OBJECTS OF THE INVENTION

It is, therefore, one of the primary objects of the present invention to provide a method of converting on off-shore installed pedestal cranes Link Belt Models 218 and 238 from mechanical to total hydraulic operation.

Another object of the present invention is to provide a method of converting on off-shore installed pedestal cranes Link Belt Models 218 and 238 from a mechanical to a total hydraulic operation that minimizes overall retrofit costs.

Yet another object of the present invention is to provide a method of converting on off-shore installed pedestal cranes Link Belt Models 218 and 238 from a mechanical to a total hydraulic operation that improves lifting capability of such cranes.

A further object of the present invention is to provide a method of converting on off-shore installed pedestal cranes Link Belt Models 218 and 238 from a mechanical to a total hydraulic operation that meets all applicable standards and mandates.

Yet a further object of the present invention is to provide a method of converting on off-shore installed pedestal cranes Link Belt Models 218 and 238 from a mechanical to a total hydraulic operation that follows an approval process.

An additional object of the present invention is to provide a method of converting on off-shore installed pedestal cranes Link Belt Models 218 and 238 from a mechanical to a total hydraulic operation that improves safety of operating such cranes.

In addition to the several objects and advantages of the present invention which have been described with some degree of specificity above, various other objects and advantages of the invention will become more readily apparent to those persons who are skilled in the relevant art, particularly, when such description is taken in conjunction with the attached drawing Figures and with the appended claims.

BRIEF DESCRIPTION OF THE VARIOUS EMBODIMENTS OF THE INVENTION

Figure 1:
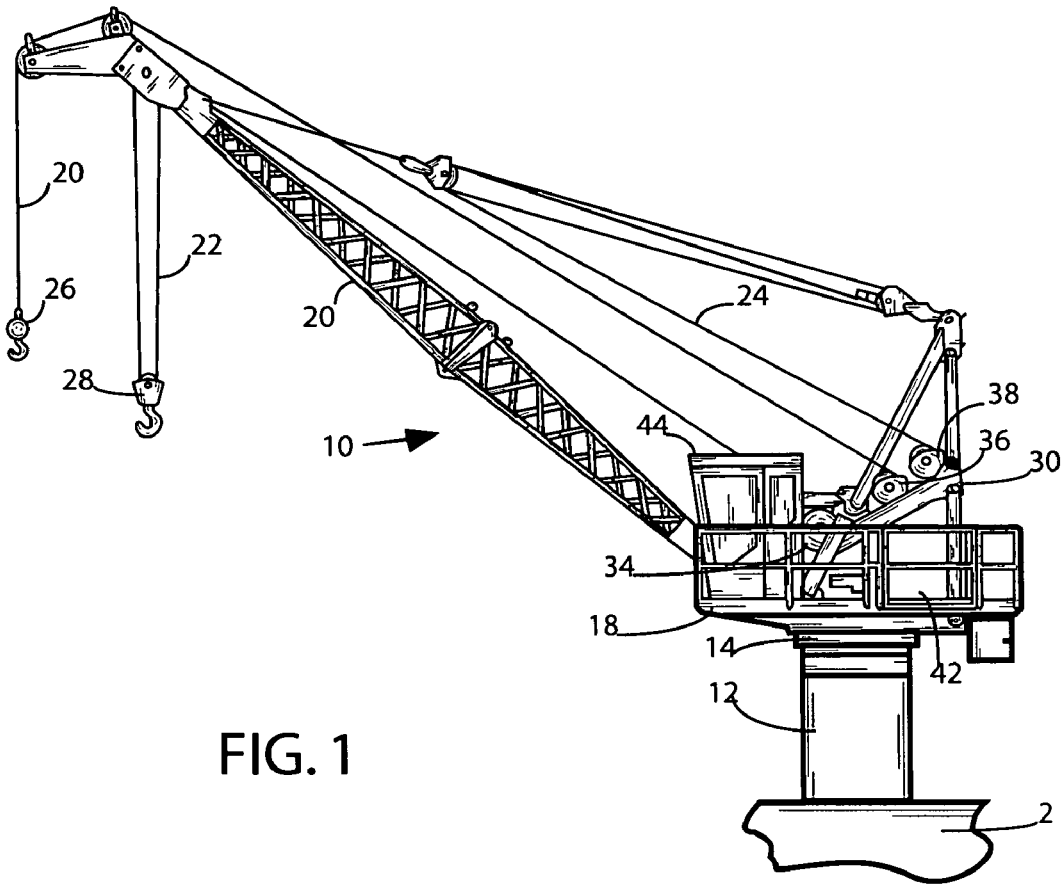
FIG. 1 is a side elevation view of a prior art off-shore platform installed pedestal type crane.
Figure 2:
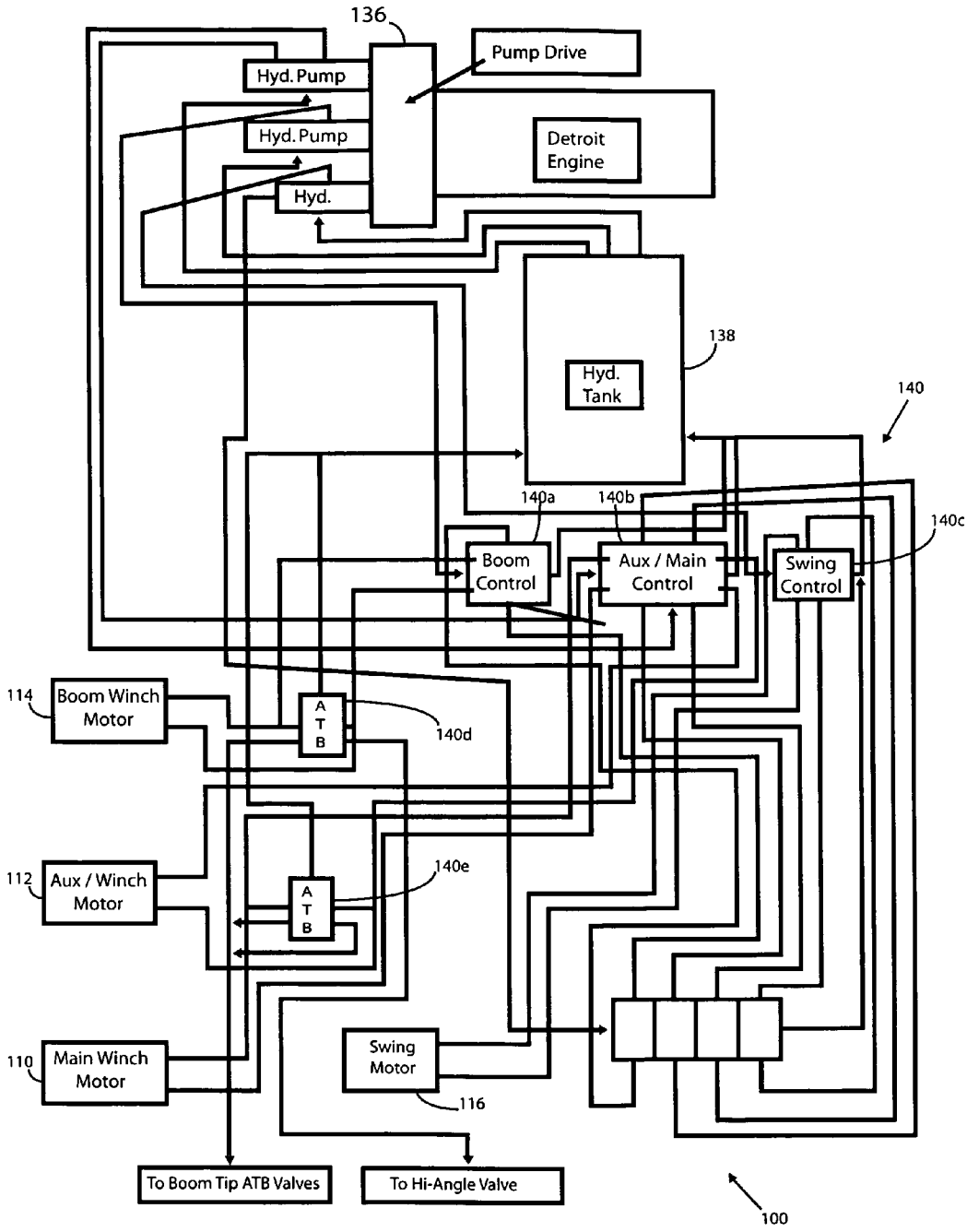
FIG. 2 is a block diagram of a hydraulic system of the present invention.

Prior to proceeding to the more detailed description of the present invention, it should be noted that, for the sake of clarity and understanding, identical components which have identical functions have been identified with identical reference numerals throughout the several views illustrated in the drawing figures.

The present invention overcomes disadvantages of existing mechanically operated cranes installed on off-shore platforms by providing a method of retrofitting/converting such off-shore installed pedestal crane from a mechanical to a hydraulic operation.

Reference is now made, to FIG. 1, wherein there is depicted a prior art mechanically operated pedestal crane, generally designated as 10, and which is generally representative of a crane manufactured by Link-Belt Construction Equipment Company under the Models ABS218, ABS238, API218A and API/ABS238A. The crane manufactured under Link Belt models 218 and 238 is generally similar to the crane construction disclosed in U.S. Pat. No. 4,582,205 issued to Berger et al.

Briefly, in reference to FIG. 1, the crane 10 includes a pedestal 12 secured to an off-shore platform 2 which is partially illustrated in FIG. 1 but which is well known in the art. A turntable 14 is attached to the pedestal 12. A main frame 18 is rotatably attached to the turntable 14. A boom assembly 20 is pivotally mounted on the main frame 18 and has cables 20, 22 and 24 connected to and suspended therefrom. Hook 26 and hook block 28 are respectively suspended from the cables 20 and 22. A winch frame 30 is secured to the main frame 18 in axial alignment with the vertical axis of the pedestal 12. The winch frame 30 has a pair of side members 32. Mechanically operated winches 34, 36 and 38 are mounted on the winch frame 30 each connected to a respective cable 20, 22, and 24. A gearbox (not shown) is attached to the frame 18 and is operably coupled to the turntable 14. An engine 42 is mounted on the main frame 18 for operating the winches 34, 36 and 36 and the gearbox 40. An operator cab 44 is secured to the main frame 18.

The method of retrofitting the existing crane 10 begins with the step of determining a capacity rating (load limit capable of being lifted by the hooks 26, 28) of the crane 10. Then, structural condition of the existing crane 10 is ascertained, by way of an inspection and/or testing, so as to determine suitability of the crane 10 for conversion. Specifically, it is verified that each structure of the main frame 18, boom assembly 20 and winch frame 30 is free of rust and corrosion so as not to prevent the converted crane 10 from achieving full capacity rating. A turntable 14 is subjected to a deflection test in order to determine presence of excessive bearing wear that would also prevent the converted crane 10 of achieving full capacity rating.

Next, operating performance parameters for a hydraulic system, generally designated as 100, are determined based on the load limit to be lifted, the travel distance of the load and applicable safety factors. Such operating parameters include but are not limited to hydraulic fluid pressure, optimum flow rates, special envelopes and the like parameters common to the hydraulic system. Determined operating parameters enable selection of various hydraulically operated members to replace existing mechanically operated components. The specific hydraulic members that are selected include, a main winch 110, auxiliary winch 112, boom winch 114, slew gearbox 116, pump drive assembly 136, reservoir 138 for storing hydraulic liquid and various control valves defining the hydraulic control system, generally designated as 140. All selected hydraulic members are capable of operating in a marine-type environment and may be manufactured, for example, by OBI of Houma, La.

Since, hydraulically operated winches 110, 112 and 114 and slew gearbox 116 have space envelops and mounting requirements that greatly differ from existing mechanically operated components being replaced, it is of a great importance to properly design mounting members 102, 104, 106 for mounting each hydraulically operated member thereon and affix such mounting members 102, 104, 106 to the vertically disposed side members 32 of the existing frame 30. In order to achieve this, the vertical side members 32 of the winch frame 30 are thoroughly inspected and analyzed and the location, size and securing method for each mounting member are identified. It has been found necessary to perform calculations to assure structural rigidity and compliance of the individual mounting member as well as the structural capability and compliance of the modified winch frame 30. Accordingly, preliminary engineering drawings are prepared for each mounting member 102, 104 and 106 and modified winch frame assembly incorporating such mounting members. Then, structural analysis are carried out, based on such engineering drawings, by individuals having expert skill in the field of relevant art. At the same time, a slew torque calculations are also carried out.

It has been determined that securing the mounting members 102, 104 and 106 to the vertical side members 32 of the winch frame 30 by a welding method provides adequate structural support for the various hydraulically operated winches 110, 112 and 114 as well as strengthens the existing winch frame 30. Accordingly, the vertical side members 32 of the winch frame 30 are chemically analyzed in order to establish optimum welding process including welding materials, equipment and steps. A welding procedure is then prepared in accordance with the applicable standards, for example such as D1.1 standard from American Welding Society (AWS) in combination with guidelines form American Petroleum Institute (API), to be strictly adhered to during the conversion process. Personnel tasked with carrying out welding of the mounting members 102, 104, 106 is certified using the prepared welding procedure.

The technical documentation including technical specifications for selected hydraulic components, engineering drawings, calculations and welding procedure(s) are submitted to the certifying agency, such as American Bureau of Shipping (ABS), that governs installation and operation of off-shore cranes in order to obtain approval for prior to beginning actual conversion effort.

After the necessary approval is obtained, the conversion process begins by removing existing mechanically operated components to be replaced and other members affected by the conversion. Specifically, being removed are various sheet metal members, operator cab 40, cables 20, 22 and 24, and members of the mechanically operated system, such as winches 34, 36, 38, brakes (not shown), clutches (not shown), drums (not shown), shafts (not shown), and controls (not shown). The winch frame 30 is then thoroughly cleaned to remove grease, oils, rust, trash and other undesirable elements. The conversion method also provides for inspecting removed existing mechanically operated and auxiliary members for presence of structural failures and for assessing capability of a remaining structure of the crane 10 to handle a higher load enabled by selected hydraulically operated members.

Figure 3:
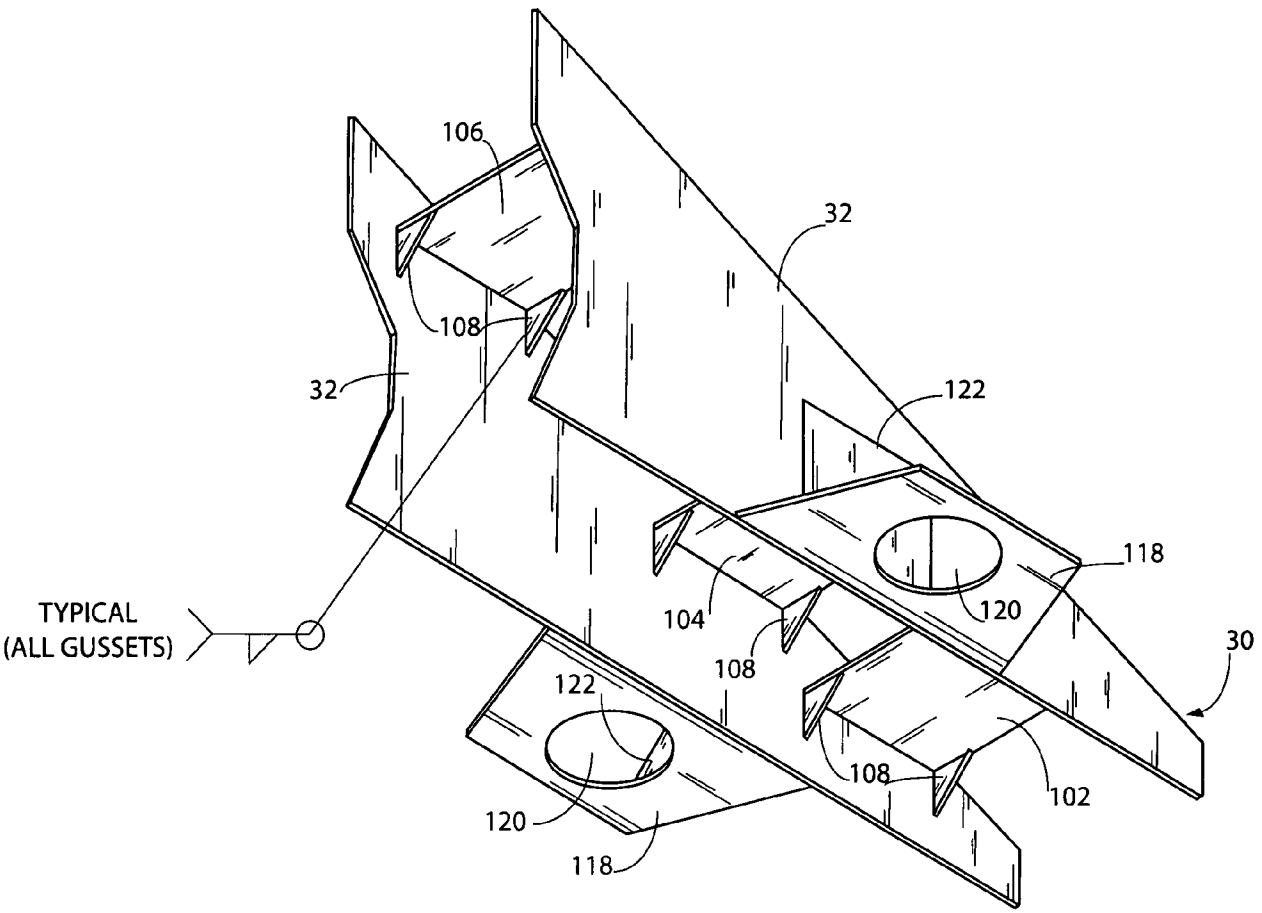
FIG. 3 is a perspective view of a modified winch frame, particularly illustrating various mounting members of the present invention.

Next, the mounting members 102, 104 and 106, best shown in FIG. 3, are rigidly secured to the vertical side members 32 of the winch frame 30. First, location of each mounting member 102, 104 and 106 is marked on an inner surface of each vertical side member 32 in accordance with previously prepared and approved engineering drawings. Then, each mounting member 102, 104 and 106 is rigidly secured in accordance with the prepared welding procedures. Support gussets 108 may be additionally welded if required by earlier performed calculations. Non-destructive testing (NDT) is performed on each weld to determine presence of any cracks. Any detected cracks are then repaired according to the welding procedure and the results of such NDT are saved to project file.

Figure 5:
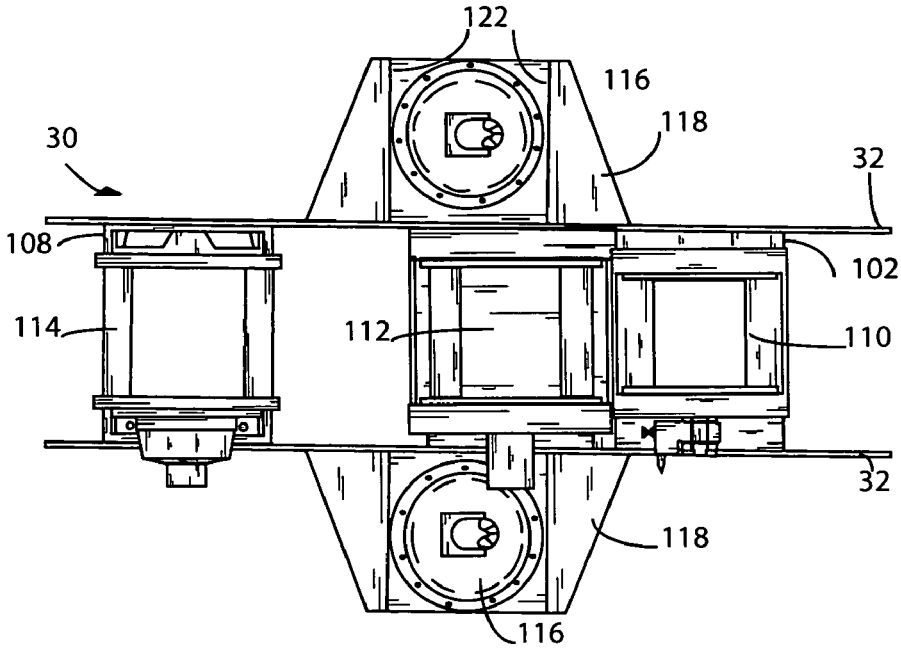
FIG. 5 is a planar view of the winch frame of FIG. 4.
Figure 4:
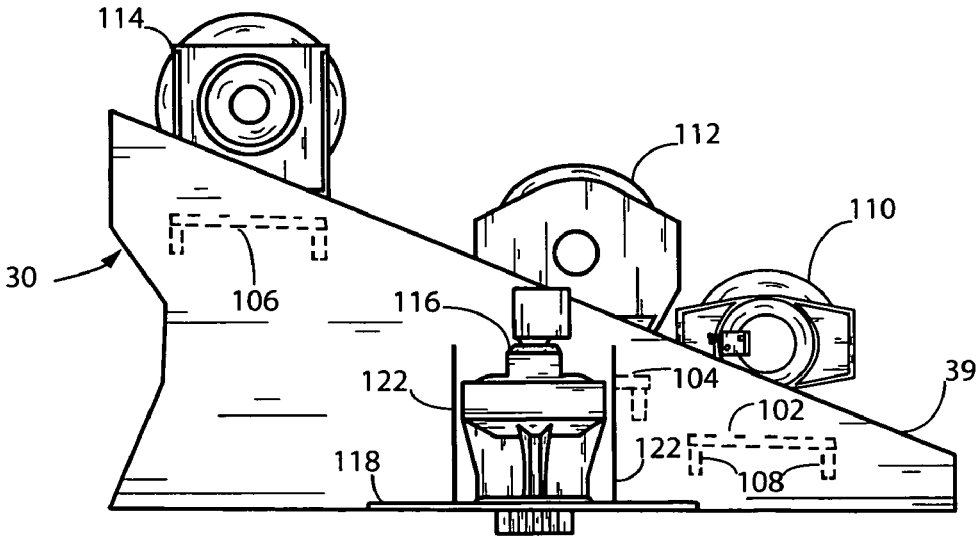
FIG. 4 is a side elevation view of the assembled and converted winch frame.

Each hydraulically operated winch 110, 112 and 114 is secured to a respective mounting member 102, 104 and 106 respectively with the use of fasteners, such as grade 8 threaded bolts and nuts (not shown). The final configuration of the converted winch assembly is shown in FIGS. 4-5.

Either in parallel or sequentially to conversion of the winch frame 30 and installation of the hydraulically operated winches 110, 112 and 114, effort is spent to convert the mechanism for pivoting the main frame 18. Initially, it was contemplated to mount a single slew gearbox 116 directly to the main frame 18. However, upon close inspection, it has been found advantageous to provide mounting member 118 and secure it, by way of a welding process, to the vertical side member 32 of the winch frame 30, as best shown in FIGS. 3-5. An aperture 120 is formed through the mounting member 118 in alignment with an aperture (not shown) in the main frame 18 for coupling the slew gearbox 116 to the turntable 14. Furthermore, it has been found necessary, for sake of structural rigidity, to join the mounting member 118 with the vertical side member 32 with a pair of gussets 122.

It has been also found that the turntable 14 is subject to significant side loads, due to cross winds, resulting in component wear and causing the gap to propagate between the turntable 14 and the gearbox 40. Such gap reduces the effectiveness of the crane 10. Thus, the present invention employs a pair of slew gearboxes 116 by positioning them symmetrical to the winch frame 30, as best shown in FIG. 5 in order to improve performance of the crane 10. Accordingly, a pair of mounting members 118 are provided and welded to the winch frame 30.

Accordingly, location of each mounting member 118 is marked on the main frame 18 in accordance with engineering drawings and the mounting members 118 are welded in accordance with the prepared welding procedures. The welds are tested by a NDT method and the test results are saved to project file. Next, each slew gearbox 116 is secured to a respective mounting member 118 with the use of fasteners, such as grade 8 threaded bolts and nuts (not shown).

The conversion effort continues with installation of the pump drive assembly 136 onto the existing engine 42, the hydraulic reservoir 138 and various control valves 140*a-e* of the hydraulic control system 140. The hydraulically operated winches 110, 112, 114 and slew gearboxes 116 are connected, by way of conventional hoses, to the control system 140, pump drive assembly 136 and reservoir 138 as depicted in 2.

Then, the hydraulic system 100 is pre-tested by purging air, inspecting for leaks and setting the operating control pressure to predetermined levels.

After the hydraulic system 100 has been pre-tested, each previously removed cable 20, 22, and 24 is attached to a respective winch 110, 112 and 114 and proper operation of the hoist and swing is verified.

The performance of the conversion effort is then tested, starting with the pre-test inspection, in accordance with established ABS/API procedure for off-shore installed cranes and includes testing of the main, auxiliary and boom hoists in a dynamic manner with a suspended load. Testing is concluded with post-test inspection in accordance with established ABS/API procedure for off-shore installed cranes and is witnessed and certified by the ABS representative. The test results are documented, signed and saved to project file located at the off-shore platform 2.

Next, the converted crane 10 is operated under normal load conditions and is again inspected for presence of any leaks. Finally, it is desirable to transport the removed components to a land-based disposal facility.

While the above described method has been found adequate in converting the existing crane form mechanical to hydraulic operation, it is presently preferred to install, test and certify performance of the conversion effort in a controlled environment prior to stating conversion process on the off-shore platform 2. Accordingly, it is within the scope of the present invention to acquire at least one existing crane 10, transport it from the off-shore platform 2 to a suitable land-based manufacturing and testing facility. There, the crane 10 is converted and tested to prove-out engineering drawings, concepts, calculations, material and component selection, welding procedures and establish operating control pressure. In such manner, the cost and duration of the overall conversion process is greatly reduced.

Thus, the present invention has been described in such full, clear, concise and exact terms as to enable any person skilled in the art to which it pertains to make and use the same. It will be understood that variations, modifications, equivalents and substitutions for components of the specifically described embodiments of the invention may be made by those skilled in the art without departing from the spirit and scope of the invention as set forth in the appended claims.

I claim:

1. A method of converting off-shore installed pedestal crane from a mechanical to a hydraulic operation, said crane having a pedestal secured to an off-shore platform, a turntable attached to said pedestal, a main frame rotatably attached to said turntable, a boom pivotally mounted on said main frame and having cables and hooks suspended therefrom, a winch frame secured to said main frame and having a pair of side members and a operator cab secured to said main frame, said method comprising the steps of:

(a) determining a load limit capable of being lifted by said hooks of said crane;

(b) ascertaining structural condition of said crane;

(c) determining operating performance parameters for a hydraulic system;

(d) selecting members of said hydraulically operated system in accordance with said operating performance parameters determined in step (c), said members including a triad of winches, a pair of gearboxes, a pump drive assembly, a reservoir of hydraulic fluid and plurality of control valves;

(e) defining configuration and position of mounting members to mount each hydraulically operated winch and gearbox selected in step (d);

(f) removing existing mechanically operated and auxiliary members to be replaced;

(g) rigidly securing each mounting member defined in step (e) to vertical side members of said winch frame;

(h) mounting each of said triad of hydraulically operated winches to a respective mounting member;

(i) attaching each cable to a respective winch;

(j) mounting each of said pair of hydraulically operated gearboxes to remaining mounting members in operable engagement with said turntable;

(k) attaching pump drive assembly to said engine;

(l) installing said reservoir of hydraulic fluid and plurality of control valves;

(m) interconnecting said hydraulically operated winches attached in step (h), said gearboxes attached in step (j), and said pump drive assembly attached in step (k) with said reservoir of hydraulic fluid and plurality of control valves installed in step (l);

(n) testing performance of said hydraulically operated members of said hydraulic system attached in steps (h), (j) and (l) and connected in step (m); and (o) certifying, by a certifying agency, performance of said hydraulic system tested in step (n).

2. The method, according to claim 1, wherein said method further includes the step of acquiring at least one crane, and the step of performing steps (f) through (n) in a controlled environment.

3. The method, according to claim 2, wherein said method further includes the step of setting operating control pressure for said hydraulic system.

4. The method, according to claim 1, wherein said step of rigidly securing said mounting members to said vertical side members of said winch frame includes the step of preparing a welding procedure in accordance with applicable standards and mandates, the step of certifying welding personnel on use of said welding procedure and the step of welding said mounting members by said certified welding personnel to said vertical side members.

5. The method, according to claim 4, wherein said method further includes the step of marking location of each mounting member on at least one surface of each of said pair of vertical side members prior to welding said each mounting member.

6. The method, according to claim 4, wherein said method further includes the step of testing each weld in a non-destructive manner and the step of recording results of said testing.

7. The method, according to claim 1, wherein said method includes the step of submitting technical documentation to said certifying agency and the step of receiving approval from said certifying agency prior to beginning removal of existing mechanically operated members in step (f).

8. The method, according to claim 1, wherein said method includes the step of saving required technical and inspection records to a project filed located at said off-shore platform.

9. The method, according to claim 1, wherein said method includes the step of performing inspection after testing said hydraulic system in step (n).

10. The method, according to claim 1, wherein said step of testing said performance of said hydraulic system includes the step of testing said performance in a dynamic manner with a suspended load.

11. The method, according to claim 1, wherein said step of certifying said performance of said hydraulic system includes the step of witnessing, by way of said certifying agency, said performance tested in step (n).

12. The method, according to claim 1, wherein said method includes the additional step of inspecting said hydraulic system for leaks under normal operating conditions of said crane.

13. The method, according to claim 1, wherein said method includes the additional step of transporting said existing mechanically operated and auxiliary members removed in step (f) to a land-based disposal facility.

14. The method, according to claim 1, wherein said method includes the additional step of inspecting said existing mechanically operated and auxiliary members removed in step (f) for presence of structural failures and the step of assessing capability of a remaining structure of said crane to handle a higher weight enabled by said hydraulically operated members tested in step (n).

15. The method, according to claim 1, wherein said step of defining configuration and position of said mounting members includes the step of determining cost effective approach of mounting said winches and gearboxes.

* * * * *